United States Patent [19]

Weaver et al.

[11] Patent Number: 4,722,149

[45] Date of Patent: Feb. 2, 1988

[54] ANTI-SHUTTLE PUMP

[75] Inventors: Firm L. Weaver, Princeton; Alan Gertz, Hamilton Square, both of N.J.; Arasu Rajaratnam, Neshaminy Valley, Pa.

[73] Assignee: Imo Delaval Inc., Trenton, N.J.

[21] Appl. No.: 834,493

[22] Filed: Feb. 25, 1986

Related U.S. Application Data

[63] Continuation of Ser. No. 726,939, Apr. 26, 1985, abandoned, which is a continuation of Ser. No. 7,810, Jan. 30, 1979, abandoned, which is a continuation of Ser. No. 844,394, Oct. 21, 1977, abandoned, which is a continuation of Ser. No. 650,005, Jan. 19, 1976, abandoned.

[51] Int. Cl.[4] ..... F04D 29/66

[52] U.S. Cl. ..... 415/1; 415/98; 415/106; 415/170 A

[58] Field of Search ..... 415/1, 97, 98, 102, 415/104, 106, 170 R, 170 A, 170 B, 172

[56] References Cited

U.S. PATENT DOCUMENTS

| | | | |
|---|---|---|---|
| 840,116 | 1/1907 | Degen | 415/106 |
| 948,228 | 2/1910 | Krogh | 415/106 |
| 1,020,699 | 3/1912 | Kieser | 415/170 A |
| 1,072,650 | 9/1913 | Price | 415/170 A |
| 1,130,616 | 3/1915 | Lorenz | 415/106 |
| 1,163,778 | 12/1915 | Scheurman | 415/106 X |
| 1,488,931 | 4/1924 | Marechal | 415/106 |
| 1,516,822 | 11/1924 | McCormack | 415/106 |
| 1,553,599 | 9/1925 | De Wein | 415/106 |
| 1,820,150 | 8/1931 | Moody | 415/172 X |
| 2,818,227 | 12/1957 | Suss | 415/170 A |
| 3,239,193 | 3/1966 | Kerensky | 415/1 |
| 4,205,942 | 6/1980 | Yokoyama | 415/106 |

FOREIGN PATENT DOCUMENTS

| | | | |
|---|---|---|---|
| 504041 | 8/1930 | Fed. Rep. of Germany | 415/172 |

*Primary Examiner*—Leonard E. Smith

*Attorney, Agent, or Firm*—Hopgood, Calimafde, Kalil, Blaustein & Judlowe

[57] ABSTRACT

A sealing arrangement is herein disclosed for use in a high energy centrifugal pump and the like wherein a chamber is defined about the discharge portion of the pump wheel which is attached to a shaft to form a rotor which rotates with respect to stationary parts and has limited axial movement as determined by the thrust bearing clearance. An annular seal is disposed operatively about the outside diameter of the pump wheel with sufficient clearance for the pump wheel to clear the seal regardless of the extent of the axial movement of the wheel. The seal acts to retard the shock waves of transient pressure differentials developed across the wheel. the seal further operates to define a dashpot arrangement wherein the wheel comprises a piston which automatically equalizes any pressure differential developed across the wheel and by-passing the seal.

1 Claim, 1 Drawing Figure

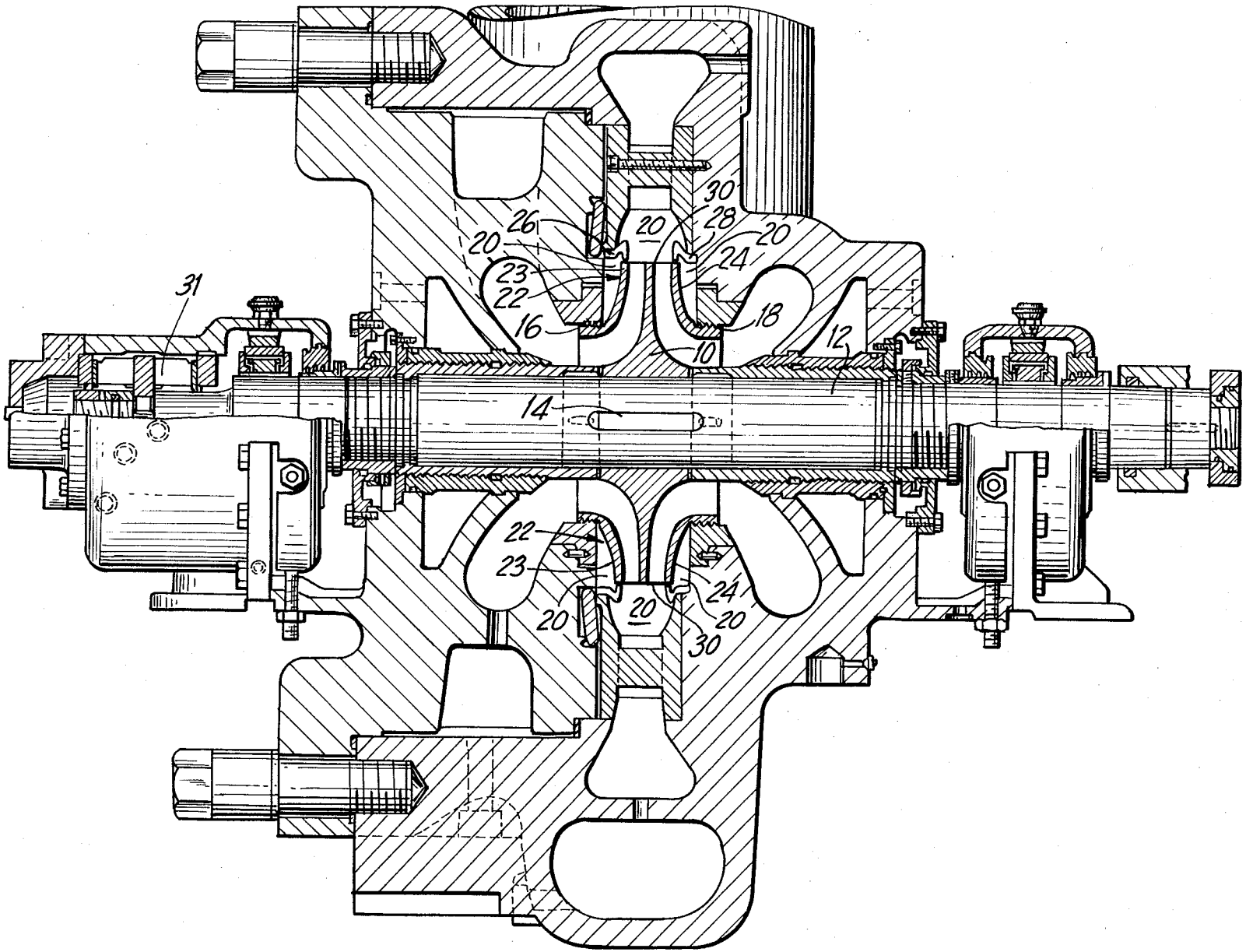
12
18
20
24
30
28
10
20
26
23
22
16
14
22
23
20
24
20
30
20
31

ANTI-SHUTTLE PUMP

This application is a continuation of application Ser. No. 726,939, filed Apr. 26, 1985, which in turn was a continuation of application Ser. No. 7,810, filed Jan. 30, 1979, which in turn was a continuation of application Ser. No. 844,394, filed Oct. 21, 1977, which in turn was a continuation of application Ser. No. 650,005, filed Jan. 19, 1976, all of which are abandoned.

BACKGROUND OF THE INVENTION

The present invention is directed to a sealing arrangement for centrifugal pumps and is especially effective when embodied in high energy centrifugal pumps used as feed pumps for nuclear reactor systems or the like.

The feed pumps utilized in electric generation systems typically handle liquids which are heated to as much as 550° F. Such pumps are of the high energy type wherein the driving power is as great as 40,000 hp and the shaft speed may be as high as 8,000 rpm. The pump wheeel of such a pump is typically provided with a radially acting inner seal operating on an axially extending portion of the wheel adjacent the shaft to prevent axial leakage of pump fluid across the wheel.

Because of the high energy nature of the wheel, there must be such a clearance radially and axially about the wheel that the stationary portions to the pump define a chamber about the discharge portion thereof. This chamber must be sufficiently large to prevent the wheel from contacting the surrounding pump surfaces which contact would severely damage the wheel. Therefore, the chamber has a sufficient volume to permit the development of significant transient pressure differentials across the pump wheel.

The applicant has discovered that these transient pressure differentials are often sufficiently great to cause axial "shuttle" of the rotor which tends to accelerate the rotor against the thrust bearings which, in turn, give extra loading to the thrust bearings and acts to deflect the bearing brackets. In the case of high energy pumps, this action can be quite extensive at low flow rates.

Usually, such transient pressure differentials are developed across the pump wheel during the start-up period of the pump. When high energy pumps are utilized in systems such as nuclear reactor systems, requiring as long as six months to build up to normal flow rates, the phenomena of "shuttle" is especially prevalent.

The applicant herein has discovered that the shuttle phenomena in such high energy centrifugal pumps may be substantially reduced or even eliminated by a unique and a very uncomplicated arrangement wherein the pump may be axially restrained against shuttle without a rigid restraining means which, in itself, could cause damage to the wheel and other parts of the pump arrangement.

OBJECTS AND SUMMARY OF THE INVENTION

It is therefore an object of the present invention to provide a solution to the problem of "shuttle" in centrifugal pumps.

It is another object of the present invention to provide such a solution which is uniquely uncomplicated while being highly effective.

Briefly stated, the inventor has found that by arranging an annular seal about the outside diameter of the pump wheel which seal is radially spaced therefrom so as to avoid contact therewith upon the axial movement of the wheel, two physical phenomena may be usd to successfully counteract shuttle. Such a seal has the effect of retarding the transmission of transient pressure differential waves across the pump wheel. Additionally, the annular space defined between the seal and the surface of the wheel shaft acts as a dashpot chamber and the wheel, itself, functions within the chamber as a dashpot piston. In operation, any unbalanced transient pressure by-passing the seal on the outside diameter of the pump wheel is automatically equalized by the resulting movement of the pump wheel (piston) from the high pressure area to the lower pressure area.

THE DRAWING

While the invention is particularly pointed out and distinctly claimed in a concluding portion of the specification, a preferred embodiment is set forth in the following detailed description which may be best understood when read in connection with the accompanying drawing which shows an axial cross-sectional view of a centrifugal pump provided with a sealing means according to the present invention.

SPECIFICATION

Referring now to the drawing, a centrifugal pump of the type typically used for nuclear reactor feed pumps is shown in axial cross-sectional view. Such pumps typically are powered by 10,000 hp source and operate at approximately 5,000 rpm.

A pump wheel 10 is mounted on a drive 12 and attached thereto to form a rotor which rotates with respect to stationary parts and has limited axial movement as determined by the thrust bearing clearance. The pump wheel 10 may be of the double suction type and in high energy pumps, is spaced axially and circumferentially from the stationary portion of the pump a sufficient distance to prevent contact therewith. Annular seals 16 and 18 are typically provided about an inner, generally axially extending circumferential surface of the pump wheel to prevent leakage across the wheel.

The annular chamber 20 then formed about the radial and axial extensions of the pump wheel is readily definable and comprises a substantial volume. Because of the high discharge pressures developed in the liquid being forced through the chambers adjacent to the pump wheel sideplates 22 and 24 and because of unstable flow during start-up periods, significant, transient pressure differentials often develop within the chamber 20 axially across the wheel 10. These pressure differentials act on the radially extending surfaces 22 and 24 of the wheel so as to axially accelerate the rotor relative to the stationary parts in a very forceful manner. This phenomena has been characterized as "shuttle."

The "shuttle" caused by transient pressure across the wheel 10 slams the pump rotor against its thrust bearings 31 which may severely damage the pump. It would, therefore, be advantageous if "shuttle" were obviated by some uniquely simple arrangement which would not interfere with the pump wheel during the operation thereof but yet would retard the troublesome transient pressure differentials developed within the chamber 20.

The present invention therefore contemplates a second sealing means 26 and 28 which essentially comprises an annular seal on the outside diameter 30 of the pump wheel 10 adjacent each radial face thereof. Specifically, annular seals 26 and 28 may be provided about the outer circumference of the pump wheel so as to be clear of contact therewith regardless of the extent of the axial movement thereof. The seals 26 and 28 are spaced from the outside diameter of the pump wheel an axial clearance sufficient to define an annular orifice operable to retard the shock waves of transient pressure differentials acting across the pump wheel.

The annular seals 26 and 28 are further operable to cooperate with the cylindrical surface of the shaft 12 to define the chamber of a dashpot arrangement wherein the wheel 10, itself, operates as the piston of the dashpot to equalize any transient pressure differential acting axially across the pump wheel as it moves axially from the high pressure side to the lower pressure side.

A sealing clearance of approximately 0.030 in. on the radius of the wheel has been found to be effective in permitting free operation of the wheel while eliminating the transmission of transient pressure waves from one axial side of the wheel to the other. Also, and very significantly, this placement of annular seals 26 and 28 produces the dashpot effect described above. In operation, any unbalanced, transient pressure bypassing the seal on the outside diameter of the pump wheel is automatically equalized by the pump wheel 10 acting as a piston and moving from the high pressure area to the lower pressure area.

While what has been described herein is a preferred embodiment of the present invention, it is to be understood that various modifications and changes may be made therein without departing from the invention. For example, the configuration of the sealing means 26 and 28 may be modified to comprise a metallic block-like member as opposed to the generally knife edge type seals shown in the accompanying drawing.

It is therefore intended to cover in the following claims all such modifications and changes as may fall within the true spirit and scope of the present invention.

What is claimed is:

1. A method for retarding transient pressure waves radiating axially across the rotor of a centrifugal pump having a chamber defined about the discharge portion of an impeller, the impeller being attached to a drive shaft to form a wheel which rotates with respect to stationary parts and has limited axial movement as determined by the thrust bearing clearance, the centrifugal pump being of the high energy type being driven in a power range of up to approximately 40,000 horsepower and developing a rotor rotational horsepower and rotor speed being such as to generate high energy shock waves and random transient pressures across the rotor during start-up periods, the method comprising the steps of positioning sealing means about the outside circumference of the impeller and spacing and sealing means annularly about the outside circumference of the impeller with sufficient radial clearance to avoid all contact therewith regardless of the extent of the axially movement imparted thereto but sufficiently close to define an annular space between said sealing means and the outside circumference of the impeller to retard high energy transient pressure waves radiating axially across the rotor.

* * * * *